United States Patent [19]

Saffo

[11] Patent Number: 4,583,535

[45] Date of Patent: Apr. 22, 1986

[54] PROTECTION MASK

[76] Inventor: John J. Saffo, 88 Chalet Ct., Lake St. Louis, Mo. 63367

[21] Appl. No.: 176,196

[22] Filed: Aug. 7, 1980

[51] Int. Cl.[4] ..... A62B 7/00

[52] U.S. Cl. ..... 128/201.25; 128/205.28; 2/7; 2/205; 2/206

[58] Field of Search ..... 2/205, 202, 206, 173, 2/171, 7; 128/201.25, 206.15, 207.12, 201.28, 205.28

[56] References Cited

U.S. PATENT DOCUMENTS

| | | | |
|---|---|---|---|
| 148,868 | 3/1874 | Barton | 128/201.25 |
| 1,827,028 | 10/1931 | Malcom | 128/207.12 X |
| 2,029,129 | 1/1936 | Schwartz | 128/206.15 |
| 2,160,317 | 5/1939 | Schwartz | 128/206.15 |
| 2,583,304 | 1/1952 | Pipher | 128/201.25 |
| 3,562,813 | 2/1971 | Origer | 2/202 X |
| 3,789,839 | 2/1974 | Lund et al. | 2/206 X |
| 4,231,118 | 11/1980 | Nakagawa | 2/205 X |

*Primary Examiner*—Peter Nerbun

*Attorney, Agent, or Firm*—Haverstock, Garrett & Roberts

[57] ABSTRACT

A protection mask is provided comprising a flexible hood having a head opening for placing said hood over the head of a wearer, said hood being made of transparent plastic for allowing the wearer to see through the walls thereof, means for gathering the head opening of said hood around the neck of the wearer, said hood having an inhale opening in the walls thereof located in the vicinity of the mouth of the wearer, filtering means covering said inhale opening for filtering air entering through said opening, and check valve means through the walls of said hood for allowing air to exit from said hood when the wearer exhales and for closing when the wearer inhales outside air through said filtering means.

5 Claims, 5 Drawing Figures

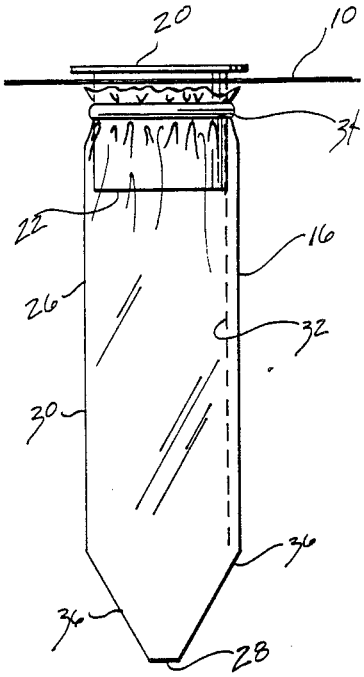
FIG. 2
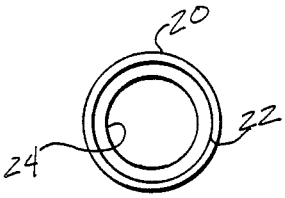
FIG. 3
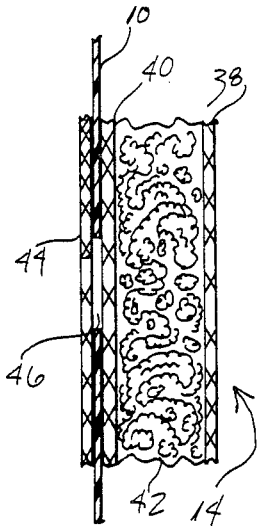
FIG. 4
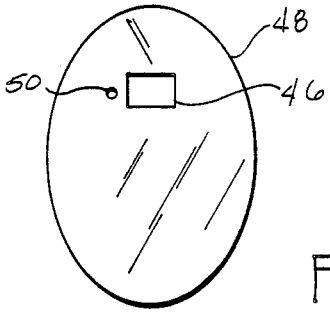
FIG. 5
FIG. 1
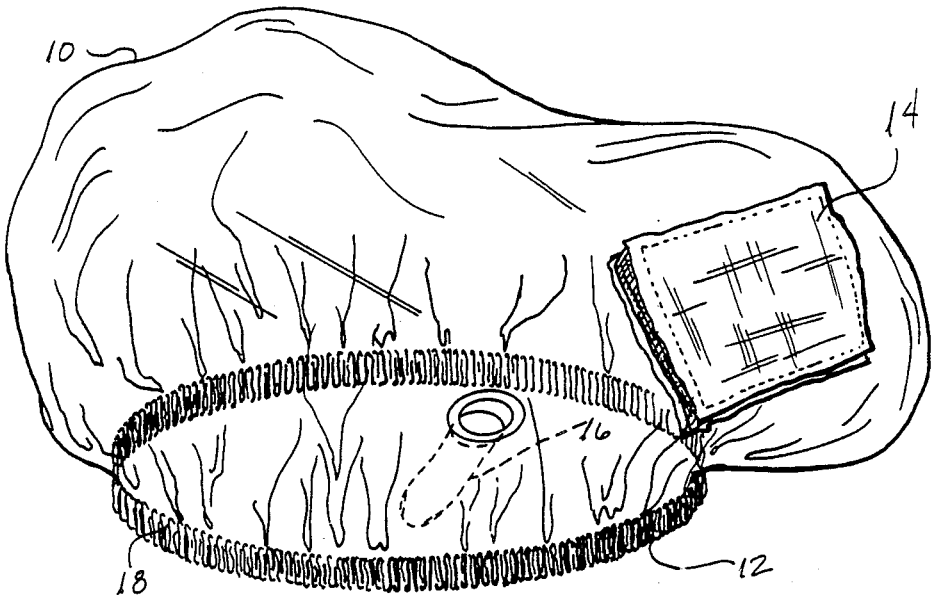

PROTECTION MASK

BACKGROUND AND SUMMARY OF THE INVENTION

This invention relates to a disposable protection mask for protecting a wearer from the smoke and fumes of a fire, or other conflagration.

The majority of fatalities in a fire are caused by inhaling smoke and fumes generated by the flames and heat of the fire, exceeding those caused by the flames and heat themselves. In many instances victims lose their way in the smoke with many dying just a few feet from safety. Not only is their vision obstructed by the smoke itself, but many times the irritants in the smoke or fumes cause victims to involuntarily close their eyes. Thus, even if a victim is able to hold his breath or cover his mouth to prevent breathing the smoke or fumes, the victim very often loses his way because of the involuntary reaction of his eyes to the smoke or fumes.

Many times a would-be rescuer rushes into a building to search for relatives or victims and is overcome by breathing smoke or loses his way to become a victim himself. For these reasons many fatalities occur even when the victims are familiar with the building in which they are trapped.

Prior smoke protection masks are cumbersome and of bulky construction and are normally associated with a separate air or oxygen supply. The prior masks are generally intended for use by fire fighting personnel over an extended period of time for conducting search and rescue operations and for fighting the fire. Many masks are custom fit for each wearer, or include complicated adjustments in order to form a seal between the mask and the face of the wearer.

The protection mask of the present invention has an opening for a person's head with an elastic band sewn into the head opening so that the mask is held snugly in place about the entire head of the wearer. The illustrative embodiment of the mask includes a filter made from layers of surgical gauze with cotton between the layers for forming an inexpensive filter means. This filter gives the wearer sufficient time to quickly exit a smoke filled building or other site without being overcome by the smoke. The mask has an exhaust valve of simple and inexpensive construction for exhausting the breath of the wearer when the wearer exhales but which closes when the wearer inhales outside air through the filter into the mask.

It is an object of the present invention to provide a protection mask of simple and inexpensive construction.

It is a further object of the invention to provide a protection mask which is disposable after use.

It is a further object of the invention to provide a protection mask which gives short term protection to its wearer such that the wearer may escape from a smoke filled building or may search for a victim in a smoke filled or burning building without being overcome by the smoke or having his vision impaired by irritants in the smoke.

It is a further object of the invention to provide a protection mask which may be easily stored in a convenient package but which may be rapidly donned in the event of an emergency.

BRIEF DESCRIPTION OF THE DRAWINGS

These and other objects and advantages of the present device will become apparent after considering the following detailed specification in conjunction with the accompanying drawings wherein:

FIG. 1 is a perspective view of the protection mask;

FIG. 2 is a side view of one embodiment of the exhaust valve of the protection mask;

FIG. 3 is a front view of the base of the exhaust valve of FIG. 2;

FIG. 4 is a cross-sectional view through the side of one embodiment of the filter element of the protection masks; and, FIG. 5 is an elevational view of the hood portion of the mask as it would appear laid out flat before being formed into a hood.

DESCRIPTION OF THE PREFERRED EMBODIMENT

Referring to the drawings more particularly by reference numbers, number 10 in FIG. 1 is the hood portion of the protection mask having an opening 12 so that the mask may be placed over the entire head of a wearer. The hood 10 has a filter element 14 through its wall located to be approximately over the mouth of a wearer when the hood 10 is in position. An exhaust valve 16 is located on one side of the hood 10 for exhausting the breath of a wearer when he exhales. The head opening 12 of the hood 10 is closed relatively tightly around the neck of the wearer such as by an elastic band 18 sewn into the head opening 12 of hood 10. Draw strings or other means could also be used with or in place of elastic band 18 to draw the head opening around the neck of a wearer to prevent entry of smoke or fumes into the protective mask between the hood 10 and the neck of the wearer when it is being worn.

It will be understood that the protection mask of the present invention may be donned by a person in the event of a fire in a very quick and uncomplicated manner. The mask can be pulled on over glasses or hearing aides, without obstructing their use or requiring their removal. The hood design of the mask also allows one size mask to be used without having to first fit the mask to the individual as is required by many prior art devices.

FIG. 2 shows a preferred embodiment of the exhaust valve 16. The embodiment of the valve 16 disclosed has a base 20 having a tubular section 22 for projecting through the walls of the hood 10. As shown in FIGS. 2 and 3, base 20 forms an annular flange projecting radially outwardly from tubular portion 22. The annular flange of base 20 prevents the exhaust valve 16 from being inadvertently pulled through the walls of hood 10, and provides an air tight seal between the face of the flange and the wall of the hood. An appropriate adhesive may be used if desired to cement base 20 to the walls of hood 10.

As shown in FIG. 3, tubular portion 22 has an interior bore 24 therethrough for allowing air to flow from inside the hood 10 to be exhausted to the atmosphere surrounding the hood 10. The exhaust valve 16 further includes a sleeve 26 formed of a thin flexible plastic film. Sleeve 26 is formed by folding the plastic film at fold 28 and sealing the edges 30 and 32 to form a sleeve which fits over the outer periphery of tube 22. The seams 30 and 32 can be formed by pressing the edges of the sleeve 26 together and applying heat causing the plastic along the seam to fuse forming an air tight seal. Adhesive may also be used as is known in the art.

One or more bias cuts 36 in the ends of the plastic sleeve 26 provide an exit passageway through sleeve 26. It will be understood that air moving from inside the hood 10 through tube 22 and plastic sleeve 26 will be exhausted through cuts 36 when the wearer exhales. When the wearer inhales, the plastic sleeve 26 will collapse closing cuts 36 and blocking flow through the valve 16.

A constrictive band such as a rubber band 34 is used to hold plastic sleeve 22 over tubular portion 22 of base 20. The rubber band 34 also serves to hold the base 20 in position in the walls of hood 10.

Other one-way valves for exhaust valve 16 may be used in the practice of the invention. One such valve is the valve having a flexible valve disc as shown in U.S. Pat. No. 2,848,994.

One embodiment of the filter element 14 is shown in cross-section in FIG. 4 and includes cotton 42 sandwiched between surgical gauze pads 38 and 40. The gauze pads 38 and 40 with the cotton 42 therebetween is located on the outside of hood 10 over an inhale opening 46 in the walls of the hood 10. A third surgical gauze pad 44 is located on the inside of hood 10 and is sewn to pads 38 and 40 through the walls of hood 10 over the inhale opening 46 to hold filter element 14 in place. Active absorbent materials such as activated charcoal may be included between gauze pads 38 and 40 with or in place of cotton 42 to make the filter element 14 more effective and give it a longer life. The effectiveness of the filter element 14 can also be increased by wetting it with water.

Other filter means may be used for the filter element 14 in the practice of the invention such as tightly woven fabric, plastic material having an open cell formation, or other fiberous or capillary tubular material for trapping smoke particles as air moves through the filtering means.

FIG. 5 shows a blank 48 which is used to form the hood 10 of the protection mask of the embodiment illustrated. The hood blank 48 can be made of any known transparent flexible plastic material. A particularly useful material is transparent vinyl chloride film, which is inexpensive and readily available in the market. Other transparent flexible sheet materials which can be used in the practice of this invention are cross-oriented polystyrene, polyolefins such as polyethylene and polypropylene, flexible nylons, certain cellulose materials and rubber hydrochloride film.

The transparent flexible plastic films which can be used in the practice of this invention may have fire retardant additives incorporated into the plastic films. For example, several well known phosphorous materials can be added in sufficient quantities to provide fire retardancy without adversely affecting the transparency of the film. Other known fire retardant additives are hydrated calcium carbonate salts and other fine particle inorganic salts. Also, boron compounds may be incorporated into the plastic films as a fire retardant additive. These and other fire retardant additives are well known in the market and discussed in the literature.

The thickness of the plastic blank 48 varies with the flexibility of the plastic used and may be in the range of about 2 mils to about 20 mils so long as the hood 10 is flexible enough to allow head opening 12 to pass over the head of a wearer and to close around the neck of the wearer when the mask is in place.

The blank 48 is of a generally oval shape wherein the longitudinal measurement of the oval is about 25% longer than the transverse measurement of the oval. The preferred size is about 25 inches by 20 inches. The blank 48 has an inhale opening 46 and a circular opening 50. The inhale opening 46 is positioned in the blank such that when the hood 10 is formed, the opening 46 is located to be generally over the mouth of the wearer of the mask. Circular opening 50 is sized to receive exhale valve 16 making a tight fit around tubular portion 22 of base 20.

It will be understood that the protection mask disclosed is of simple and inexpensive construction which may be stored in a collapsed state in a small, convenient package and which may be quickly donned without complicated instructions or procedures. The mask may be donned in an emergency situation over eye glasses, hearing aids, earrings or other pieces of jewelry without first having to remove them. The mask may be donned in any orientation and then adjusted with the filter unit 14 over the mouth of the wearer. It is also apparent that the protection mask would work if put on by the wearer in an orientation other than the preferred orientation. The mask could then be adjusted by sliding hood 10 around the wearer's neck as desired. This adjustment can be made without affecting the operation of the mask.

In addition to providing protection from the smoke of a fire, the mask of the invention can be used to protect the wearer from chemical fumes as would be present at the site of an industrial accident, or as protection by an operator of a sprayer of, for instance, agricultural insecticides or herbicides. Filter 14 may be impregnated with an active absorbent ingredient for the particular dust, chemical or spray from which protection is sought.

Thus there has been shown and described an embodiment of a novel protection mask which fulfills the objects and advantages sought therefor. It will be apparent to those skilled in the art, however, that many changes, modifications, variations, and other uses and applications for the subject devices are possible. All such changes, modifications, variations, and other uses and applications which do not depart from the spirit and scope of the invention are deemed to be covered by the invention which is limited only by the claims which follow.

What is claimed is:

1. A protection mask comprising a flexible hood having an inside surface and an outside surface, a head opening for placing said hood over the head of a wearer, said hood being made of transparent plastic for allowing the wearer to see through the hood, said transparent plastic having at least one fire retardant additive incorporated therein, an elastic band for gathering the head opening of said hood around the neck of the wearer, said hood having an inhale opening located in the vicinity of the mouth of the wearer, filtering means covering said inhale opening for filtering air entering through said opening wherein said filtering means comprises at least one gauze pad sewn over the outside of said inhale opening of said hood and another gauze pad sewn on the inside of said hood over said inhale opening, said filtering means including charcoal positioned between said gauze pads, and check valve means through said hood which opens to allow air to exit from said hood when the wearer exhales and which closes when the wearer inhales outside air through said inhale opening and through said filtering means, wherein said check valve means is located on one side of said bond spaced from said inhalation opening and comprises an elongate tube extending through said hood, said elongated tube having a base portion defined by an annular flange projecting radially outwardly from said tube and being attached on the inside surface of said hood, said base portion being adapted to prevent said tube from being pulled through said hood, said tube projecting from said base portion, through said hood, outside of said mask and into a readily expandible and collapsible sleeve formed of a flexible plastic film, said sleeve having an end portion which terminates in a free end remote from said tube and which progressively decreases in cross-section in a direction extending toward said free end, said end portion having at least one opening which allows air to exit from said hood through said tube and sleeve when the wearer exhales and which closes to block passage of air through said tube when the wearer inhales, said opening being elongated at least in the general direction of the longitudinal axis of said sleeve.

2. A protection mask according to claim 1 wherein said filtering means comprises a filtering medium between first and second gauze pads sewn over the inhale opening of said hood.

3. A protection mask according to claim 1 wherein said first, second and third gauze pads are comprised of cotton.

4. A protection mask according to claim 1 wherein said hood is made of vinyl chloride flim.

5. A protection mask according to claim 1 wherein said hood is made from a single piece of plastic in a generally oval shape having a longitudinal measurement about 25% longer than a transverse measurement.

* * * * *

UNITED STATES PATENT AND TRADEMARK OFFICE

CERTIFICATE OF CORRECTION

PATENT NO. : 4,583,535

DATED : April 22, 1986

INVENTOR(S) : John J. Saffo

It is certified that error appears in the above—identified patent and that said Letters Patent is hereby corrected as shown below:

Column 5, line 1, delete "bond" and substitute therefor --hood--.

Column 6, line 12, delete "flim" and substitute therefor --film--.

Signed and Sealed this

*Fifth* Day of *August 1986*

[SEAL]

*Attest:*

DONALD J. QUIGG

*Attesting Officer*

*Commissioner of Patents and Trademarks*